United States Patent [19]

Kissling et al.

[11] Patent Number: 4,475,918

[45] Date of Patent: Oct. 9, 1984

[54] COMPOSITION AND METHOD FOR IMPROVING THE FASTNESS OF ANIONIC DYES AND BRIGHTENERS ON CELLULOSIC AND POLYAMIDE FIBERS

[75] Inventors: Bruno Kissling, Hagendorf; Tibor Robinson, Basel, both of Switzerland

[73] Assignee: Sandoz Ltd., Basel, Switzerland

[21] Appl. No.: 526,002

[22] Filed: Aug. 24, 1983

[30] Foreign Application Priority Data

Aug. 30, 1982 [DE] Fed. Rep. of Germany ..... 3232195

[51] Int. Cl.[3] ..... C08L 61/32

[52] U.S. Cl. ..... 8/495; 8/554; 8/556; 8/680; 8/918; 8/924; 252/301.21; 524/195; 524/598; 525/509; 528/254; 528/256; 528/257; 528/258; 528/259; 528/263

[58] Field of Search ..... 8/554, 556, 495; 524/195, 598; 525/509; 528/256, 258, 263

[56] References Cited

U.S. PATENT DOCUMENTS

| | | | |
|---|---|---|---|
| 2,573,489 | 10/1951 | Rheiner et al. | 8/442 |
| 2,631,920 | 3/1953 | Albrecht | 8/556 |
| 2,649,354 | 8/1953 | Hemmi | 8/551 |
| 3,141,728 | 7/1964 | Bockmann | 8/551 |
| 4,410,652 | 10/1983 | Robinson et al. | 524/195 |

FOREIGN PATENT DOCUMENTS

| | | |
|---|---|---|
| 657753 | 9/1951 | United Kingdom . |
| 2093076 | 2/1981 | United Kingdom . |
| 2070006 | 9/1981 | United Kingdom . |
| 2084597 | 4/1982 | United Kingdom . |

*Primary Examiner*—A. Lionel Clingman

*Attorney, Agent, or Firm*—Gerald D. Sharkin; Richard E. Vila; Thomas C. Doyle

[57] ABSTRACT

Aftertreatment of dyeings on cotton or nylon with (A) a polybasic compound which is the product of reacting a primary or secondary amine with cyanamide, dicyandiamide, guanidine or biguanidine and, sequentially or simultaneously (B) a precondensate formed by reacting a compound of type (A) with an N-methylol derivative gives wet fastness properties superior to those given by either (A) or (B) used alone.

24 Claims, No Drawings

COMPOSITION AND METHOD FOR IMPROVING THE FASTNESS OF ANIONIC DYES AND BRIGHTENERS ON CELLULOSIC AND POLYAMIDE FIBERS

This invention relates to a process for improving the fastness properties of dyes and optical brighteners on hydroxy group-containing fibrous substrates, or on natural or synthetic polyamide substrates.

The invention provides a process for improving the fastness properties of anionic dyestuffs or optical brighteners on a substrate comprising hydroxy group-containing fibres or natural or synthetic polyamide fibres, by applying to the dyed, printed or brightened substrate, sequentially or simultaneously (A) a polybasic compound which is the product of reacting a mono- or polyfunctional primary or secondary amine with cyanamide, dicyandiamide (DCDA), guanidine or biguanidine; whereby up to 50 mole % of the cyanamide, DCDA, guanidine or biguanidine may be replaced with a dicarboxylic acid or a mono- or di-ester thereof, said product (A) containing reactive hydrogen atoms bound to nitrogen, and (B) a precondensate formed by reacting a compound of the type (A) above with (C) an N-methylol derivative of a urea, melamine, guanamine, triazinone, urone, carbamate or acid amide said precondensate (B) being applied to the substrate together with (D) a catalyst for the crosslinking of N-methylol compounds of the type (C) above and carrying out a final heat-curing step.

Preferably the substrate is dyed with a direct or reactive dyestuff if hydroxy group-containing, and with an acid or reactive dyestuff is polyamide-containing.

Product (B), together with catalyst (D), is applied to the substrate in aqueous solution by dipping, spraying, foam application, padding or other conventional application techniques, preferably by padding. Product (A) may be applied by any of these techniques, or by an exhaust process from a short or long bath.

Preferred aftertreatment processes according to the invention are (1) simultaneous application of (A) and (B) (together with D) by padding and (2) application of (A) by an exhaust process followed by application of (B) (together with D) by padding. In case (2), the two application steps may be carried out at different stages of manufacture; for example dyed yarn or even loose fibres can be prefixed with product (A) and the final woven or knitted fabric may then be padded with (B) (+D).

The hydroxy group-containing fibres are preferably cellulosic, i.e. natural or regenerated cellulose (viscose), preferably cotton. The polyamide fibres are preferably wool, silk or nylon. Mixed cellulose/polyamide substrates may also be used.

Preferably product (B) is padded at 70–100% pick-up from a solution containing 10–80 g/l of (B), more preferably 20–60 g/l, particularly 20–50 g/l. Product (A), when applied by padding, is normally applied at 70–100% pick-up from a solution containing 3–30 g/l, preferably 5–10 g/l. When applied from an exhaust bath, it is preferably applied in a quantity corresponding to 0.5–2% of the dry weight of substrate.

Preferred conditions for exhaust application of (A) are at pH 4–7, more preferably 4–4.5 and temperatures of 30°–70° C. for a time of 10–30 minutes.

The substrate is finally subjected to a heat curing step such as is conventional for resin treatments based on compounds of type (B). The substrate may for example be dried at 70°–120° C. and finally cross-linked at a temperature of 130°–180° C. for 30 seconds to 8 minutes, or alternatively simultaneously dried and cross-linked by heat treatment at 120°–200° C., preferably 140°–180° C. for 5 seconds to 8 minutes depending on the temperature. A preferred process involves heating the padded substrate to 150°–170° C. for 60 to 90 seconds. Whichever process is used to apply (A) and (B), additional auxiliary agents for example softening agents, wetting agents, wet-proofing agents, sewing lubricants, etc. may be added at the same time.

Product (A) is preferably the reaction product of a monofunctional amine of formula Ia $$\text{RRNH} \qquad \text{Ia}$$

or a polyfunctional amine of formula Ib $$\text{RRN-}(\text{Z—X})_n\text{Z—NRR} \qquad \text{Ib}$$

in which each

R independently is hydrogen or a $C_{1-10}$alkyl group unsubstituted or monosubstituted with hydroxy, $C_{1-4}$alkoxy or cyano, provided that in formula Ia, at least one R is other than hydrogen;

n is a number from 0 to 100;

Z, or each Z independently when $n>0$, is $C_{1-4}$alkylene or hydroxyalkylene; and X, or each X independently when $n>1$, is —O—, —S— or —NR— where R is as defined above, provided that the amine of formula Ib contains at least one reactive —NH— or —$NH_2$ group, with cyanamide, dicyanodiamide (DCDA) or guanidine.

More preferably, product (A) is the reaction product of a polyfunctional amine of formula Ib with cyanamide, DCDA or guanidine. In the amines of formula Ib, R is preferably hydrogen or $C_{1-4}$alkyl or hydroxyalkyl, more preferably each R is hydrogen. n is preferably a number from 0 to 30, which may be non-integral representing an average value. More preferably n is an integer from 1 to 6. Z is preferably a 1,2-ethylene, 1,3-propylene or 1,3-(2-hydroxypropylene) group, X is preferably —NR—, most preferably —NH—.

Particularly preferred amines are diethylene triamine, triethylene tetramine and higher polyethylene polyamines, polypropylene polyamines, or poly(hydroxypropylene) polyamines containing up to 8, preferably up to 6, N atoms.

In the reaction with cyanamide, DCDA, guanidine or biguanidine, the amines may be in free base or in salt form, for example in the carbonate form, and mixtures of amines may be used. Preferred reagents are guanidine and DCDA, particularly DCDA and particularly preferred products (A) are the reaction products of diethylene triamine, triethylenetetramine or 3-(2-aminoethyl)-aminopropylamine with DCDA.

Products (A) are known, and their preparation is described for example in British Pat. No. 657 753, U.S. Pat. Nos. 2,649,354 and 4,410,652 and British Patent Application No. 2 070 006 A.

Similarly, precondensates (B) are described in U.S. Pat. No. 4,410,652 and British Patent Application No. 2 070 006 A. The product (A) which is reacted with (C) to make precondensate (B), and the product (A) which is applied to the substrate may be the same or different.

The components (C) are generally those water-soluble N-methylol compounds which are known as crosslinking agents for cellulose fibres and are used to impart a crease-resistant finish to cellulose fabrics. The compounds may contain free N-methylol groups

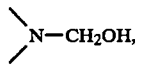

or these may be etherified. Preferred ether derivaties are the lower alkyl ethers having 1 to 4 carbon atoms in the alkyl groups. Examples of suitable N-methylol compounds are given in British Patent Application No 2 070 006 A and U.S. Pat. No. 4,410,652.

Particularly suitable are hydrolysis-resistant rective resin precursors, for example N,N'-dimethylol-4,5-dihydroxy- or 4,5-dimethoxy-ethyleneurea, N,N'-dimethylol-4-methoxy-5,5-dimethylpropyleneurea and N,N'-dimethyol carbamates, optionally in etherified form. Preferred ether forms are the methyl and ethyl derivatives.

The N-methylol compound (C) is generally obtained in the form of an aqueous solution containing approx. 40–50% by weight of (C), and may be used as such in the reaction with (A), or may be further diluted with water.

The reaction between components (A) and (C) is carried out in an aqueous medium, for example by adding (A) in solid form or as an aqueous concentrate gradually to an aqueous solution of (C), preferably containing 30–50% (C) and 50–70% water by weight. The aqueous medium preferably has a pH between 4 and 6.

It is strongly preferred that the catalyst (D) be present during the reaction of (A) and (C) to form the precondensate (B). Suitably it is dissolved in the aqueous solution of (C) before addition of (A). However, if (A) and (C) can react together adequately in the absence of (D), then the catalyst (D) may be added to the precondensate subsequently. The relative quantities of (A), (C) and (D) are also described in British Patent Application No. 2 070 006 A and U.S. Pat. No. 4,410,652.

Suitable catalysts (D) are of the type used for the crosslinking of N-methylol compounds (C) on cellulose, and examples are given in British Patent Application No. 2 070 006 A. Preferred catalysts are the nitrates, sulphates, chlorides and dihydrogen orthophosphates of aluminium, magnesium or zinc, more preferably of magnesium, particularly magnesium chloride, optionally together with an alkali metal sulphate, particularly sodium sulphate.

The invention also provides a composition comprising a mixture of product (A) and product (B), in a weight ratio of from 1:2 to 1:12.

Particularly suitable direct and reactive dyestuffs for fixation according to the present invention are described in British Patent Application Nos. 2 070 006 A and 2 093 076 A and U.S. Pat. No. 4,410,652.

Preferred anionic dyes for fixation on polyamide, particularly on synthetic polyamide, are anionic mono- or polysulphonated dyestuffs of molecular weight from 400–1000, optionally in metal complex form. More preferred dyestuffs have at least two sulphonic acid groups and a molecular weight of 600–1000, optionally in metal complex form, particularly metal complex forms having a molecular weight of 800–10000.

A preferred group of dyestuffs are C.I. Acid Dyes which exhaust on to nylon 6 to the extent of at least 50% from an aqueous bath containing twice the amount required to give a 1/1 standard depth dyeing, at a goods-to-liquor ratio of 1:30 after 60 minutes at pH 3–11 and a temperature of 30°–98° C.

Suitable acid dyes are disclosed in the following patent literature; German Pat. Nos. 1 644 356, 2 013 783, 2 153 548; German published applications (DOS) Nos. 2 202 419, 2 400 654, 2 631 830, 2 729 915, 3 034 576; French Pat. Nos. 7 506 109 and 7 624 658.

The polyamide may also be dyed with reactive dyestuffs which are conventional for use on polyamide fibres.

Both product (A) and product (B) are known for the aftertreatment of dyeings on cotton to improve wet fastness properties. However, it has now surprisingly been found that when both are used, either sequentially or simultaneously, a synergistic effect is obtained which enables better results to be obtained than for either product used alone.

Thus product (B) is normally recommended for use on cotton in amounts of 80–130 g/l of padding solution. In these concentrations, the product also gives a crease-resistant finish, which is not always desired, and for many applications the handle of the goods is harsher than is desirable. The use of product (A) together with (B), or in an earlier prefixation step, enables (B) to be used in quantities of 20–60 g/l or less, giving a softer handle but equally good wetfastness properties as are given by the higher quantities of product (B) alone.

In wash fastness tests (multiple wash at 60° C.), it is found for example that in a combined process 5 g/l of (A) plus 20 g/l of (B) gives superior results to either 10 g/l of (A) alone or 40 g/l of (B) alone.

The following Examples illustrate the invention:

EXAMPLE 1

(a) A cotton poplin fabric is dyed in conventional manner with 2.2% (based on dry weight of substrate) of C.I. Direct Red 83, and the dyeing fixed, rinsed and soaped at the boil.

(b) The dyeing obtained in (a) is padded with a solution containing 5 g/l of a product ($\alpha_1$) obtained by condensation of 1 mole diethylene triamine with 1 mole DCDA at 110°–160° C. (as in Example 1, first paragraph, British Patent Application No. 2 070 006 A and U.S. Pat. No. 4,410,652) and 40 g/l of a product ($\beta_1$) obtained by reaction of ($\alpha_1$) with dimethyloldihydroxyethyleneurea in the presence of $MgCl_2$ as described in Example 1, BPA No. 2 070 006 A. The padded substrate is squeezed to a pick up of 80%, and shock-dried on a tension frame at 180° C., 1 minute.

The resulting red dyeing exhibits good wash fastness, with no change of shade, even after multiple 60° C. washing. The fastness properties are superior to these produced by treatment with larger amounts of ($\alpha_1$) alone or ($\beta_1$) alone.

EXAMPLE 2

Example 1 is repeated using 10 g/l of ($\alpha_1$) in place of 5 g/l. Similarly good results are obtained.

EXAMPLE 3

A 2% dyeing on cotton with the dyestuff C.I. Direct Blue 90 is padded and cured as described in Example 1, using a solution containing 5 g/l ($\alpha_1$) and 20 g/l ($\beta_1$). A blue dyeing with similarly good fastness properties is obtained.

EXAMPLE 4

A 3% dyeing on cotton with the dyestuff C.I. Direct Blue 231 is rinsed and then treated in the same bath with 1.5% (based on dry wt. of goods) of product ($\alpha_1$) at a pH of 4.3, for 20 minutes at 60° C. The substrate is dried and then padded and cured as described in Example 1, using a padding liquor containing 30 g/l ($\beta_1$).

The aftertreated dyeing had superior wet fastness properties to dyeings aftertreated with ($\alpha_1$) or ($\beta_1$) alone.

EXAMPLE 5

A cotton tricot fabric is dyed with 8% C.I. Reactive Blue 79, and the dyeing fixed in conventional manner, without soaping. The dyed substrate is treated as described in Example 1, using the same padding liquor. A blue dyeing is obtained, having better fastness properties than the same dyeing aftertreated with ($\alpha_1$) or ($\beta_1$) alone.

EXAMPLE 6

A cotton tricot fabric is dyed a brilliant green by a combination of 1% C.I. Reactive Yellow 111 and 2% C.I. Reactive Blue 116, in conventional manner. The green dyeing is rinsed for 5 minutes, giving goods having residual unfixed dyestuff. The dyed fabric is treated as described in Example 1 with a padding liquor containing 10 g/l ($\alpha_1$) and 20 g/l ($\beta_1$). The wash fastness of the after-treated dyeing is superior to that obtained by after-treatment with the individual products.

EXAMPLE 7

A mixed textile fabric of 50% nylon 6 and 50% cotton is dyed in conventional manner with the dyestuffs C.I. Acid Blue 296 and C.I. Acid Blue 225 for the polyamide component and C.I. Direct Blue 251 for the cotton component.

The resulting dyeing is treated as described in Example 1, using the same padding liquor. Both the polyamide and the cotton components have improved wet- and wash-fastness, which are superior to those given by ($\alpha_1$) or ($\beta_1$) alone.

EXAMPLE 8

A fabric of nylon 6 is dyed in conventional manner with the dyestuff C.I. Acid Red 128. The dyed substrate is impregnated with a bath containing 5 g/l of ($\alpha_1$) and 40 g/l of ($\beta_1$), dried and heat treated with hot air at 180° C. for 40 seconds.

The dyeing so obtained has superior wet fastness properties than that given by treatment with ($\alpha_1$) alone or ($\beta_1$) alone. Similarly good wet fastness properties and, additionally, improved light fastness, can be obtained by treating in the same way dyeings on nylon 6 with C.I. Acid Blue 113, C.I. Acid Red 399 or C.I. Acid Blue 310.

What is claimed is:

1. A process for improving the fastness properties of an anionic dyestuff or optical brightener on a substrate comprising hydroxy group-containing fibres or natural or synthetic polyamide fibres which comprises applying, sequentially or simultaneously, to such a substrate dyed, printed or brightened with such a dyestuff or optical brightener (A) a polybasic compound which is the product of reacting a mono- or polyfunctional primary or secondary amine with cyanamide, dicyandiamide, guanidine or biguanidine or with a mixture of at least 50 mole % of the cyanamide, dicyandiamide, guanidine or biguanidine and a dicarboxylic acid or a mono- or di-ester thereof, said product (A) containing reactive hydrogen atoms bound to nitrogen, and (B) a precondensate formed by reacting a compound of type (A) above with (C) an N-methylol derivative of a urea, melamine, guanamine, triazinone, urone, carbamate or acid amide, said precondensate (B) being applied to the substrate together with (D) a catalyst for the crosslinking of N-methylol compounds of the type (C) above, and heat-curing the thus-treated substrate.

2. A process according to claim 1 in which the substrate comprises cotton fibres dyed with a direct or reactive dye.

3. A process according to claim 1 in which (A) and (B) together with (D) are applied simultaneously to the substrate by padding.

4. A process according to claim 1 in which (A) is applied to the substrate by an exhaust process and (B) together with (D) is applied subsequently by padding.

5. A process according to claim 4 in which dyed yarn or loose fibres are prefixed with (A) and the final woven or knitted fabric is padded with (B) together with (D).

6. A process according to claim 1 in which product (B) is padded at 70–100% pick-up from a solution containing 10–80 g/l of (B).

7. A process according to claim 6 in which the solution contains from 20–50 g/l of (B).

8. A process according to claim 1 in which product (A) is padded at 70–100% pick-up from a solution containing 3–30 g/l (A).

9. A process according to claim 8 in which the solution contains from 5–10 g/l (A).

10. A process according to claim 4 in which product (A) is applied from an exhaust bath in a quantity corresponding to 0.5–2% of the dry weight of substrate.

11. A process according to claim 1 in which product (A) is the reaction product of a monofunctional amine of formula Ia $$RRNH \qquad \text{Ia}$$

or polyfunctional amine of formula Ib $$RRN\text{-}(Z\text{—}X)_n Z\text{—}NRR \qquad \text{Ib}$$

in which each

R independently is hydrogen or a $C_{1-10}$alkyl group unsubstituted or monosubstituted with hydroxy, $C_{1-4}$alkoxy or cyano, provided that in formula Ia, at least one R is other than hydrogen;

n is a number from 0 to 100;

Z, or each Z independently when $n>0$, is $C_{1-4}$alkylene or hydroxyalkylene; and X, or each X independently when $n>1$, is —O—, —S— or —NR— where R is as defined above, provided that the amine of formula Ib contains at least one reactive —NH— or —$NH_2$ group, with cyanamide, dicyanodiamide (DCDA) or guanidine.

12. A process according to claim 11 in which product (A) is the reaction product of diethylene triamine, triethylenetetramine or 3-(2-aminoethyl)-aminopropylamine with DCDA.

13. A process according to claim 1 in which component (C) is selected from N,N'-dimethylol-4,5-dihydroxy-ethyleneurea, N,N'-dimethylol-4,5-dimethoxyethyleneurea, N,N'-dimethylol-4-methoxy-5,5-dimethylpropyleneurea, N,N'-dimethylol carbamates and the methyl and ethyl ethers of these.

14. A process according to claim 1 in which the catalyst (D) is selected from nitrates, sulphates, chlorides and dihydrogen orthophosphates of aluminium, magnesium and zinc.

15. A process according to claim 14 in which product (A) is the reaction product of diethylene triamine with DCDA, and product (B) is the product of reacting the same product (A) with dimethyloldihydroxyethyleneurea in the presence of magnesium chloride.

16. A process according to claim 1 in which (B) is a precondensate formed by reacting (A) with (C) in the presence of (D).

17. A process according to claim 11 in which (B) is a precondensate formed by reacting a product (A) with a component (C) selected from N,N'-dimethylol-4,5-dihydroxy-ethyleneurea, N,N'-dimethylol-4,5-dimethoxy-ethyleneurea, N,N'-dimethylol-4-methoxy-5,5-dimethyl-propyleneurea, N,N'-dimethylol carbamates and the methyl and ethyl ethers of these.

18. A process according to claim 17 wherein catalyst (D) is selected from nitrates, sulphates, chlorides and dihydrogen orthophosphates of aluminum, magnesium and zinc.

19. A process according to claim 18 wherein product (A) is the reaction product of a polyfunctional amine of formula Ib with cyanamide, dicyandiamide or guanidine.

20. A process according to claim 1 in which (A) and (B) are applied to the substrate from aqueous solution, (A) being present in an amount of 3 to 30 g. per liter of solution and (B) being present in an amount of 10 to 80 g. per liter of solution.

21. A process according to claim 19 in which (A) and (B) are applied to the substrate from aqueous solution, (A) being present in an amount of 3 to 30 g. per liter of solution and (B) being present in an amount of 10 to 80 g. per liter of solution.

22. A process according to claim 1 wherein (A) and (B) are applied in the form of a mixture in which the weight ratio of (A):(B) is in the range 1:2 to 1:12.

23. A process according to claim 17 wherein (A) and (B) are applied in the form of a mixture in which the weight ratio of (A):(B) is in the range 1:2 to 1:12.

24. A process according to claim 19 wherein (A) and (B) are applied in the form of a mixture in which the weight ratio of (A):(B) is in the range 1:2 to 1:12.

* * * * *